United States Patent [19]

Yamaguchi et al.

[11] Patent Number: 4,758,495

[45] Date of Patent: Jul. 19, 1988

[54] DIAZO MICROCAPSULE RECORDING MATERIAL PREPARED USING ION EXCHANGE TREATMENT

[75] Inventors: Jun Yamaguchi; Toshimasa Usami; Sumitaka Tatsuta, all of Shizuoka, Japan

[73] Assignee: Fuji Photo Film Co., Ltd., Kanagawa, Japan

[21] Appl. No.: 844,491

[22] Filed: Mar. 26, 1986

[30] Foreign Application Priority Data

Mar. 26, 1985 [JP] Japan ..... 60-63085

[51] Int. Cl.[4] ..... G03C 1/52; G03C 1/58; G03C 1/60; B41M 5/18

[52] U.S. Cl. ..... 430/138; 503/214

[58] Field of Search ..... 430/138; 503/214

[56] References Cited

U.S. PATENT DOCUMENTS

| | | | |
|---|---|---|---|
| 3,111,407 | 11/1963 | Lindquist et al. | 430/138 |
| 3,173,878 | 3/1965 | Reyes | 430/138 |
| 3,202,510 | 8/1965 | Hollmann | 430/138 |
| 3,322,556 | 5/1967 | Munder et al. | 430/138 |
| 3,620,740 | 11/1971 | Poot | 430/138 |
| 4,529,681 | 7/1985 | Usami et al. | 430/138 |

*Primary Examiner*—Charles L. Bowers, Jr.

*Attorney, Agent, or Firm*—Sughrue, Mion, Zinn, Macpeak & Seas

[57] ABSTRACT

A process for preparing a recording material comprising a support and a recording layer on the support, said recording layer containing a coupling agent and containing microcapsules containing a diazo compound, wherein a microcapsule dispersion which is coated on the support to form the recording layer is prepared by preparing an emulsion containing at least a diazo compound and a microcapsule wall-forming substance, forming microcapsule walls on emulsion droplets, and removing diazo compound remaining unincluded in the microcapsules formed from the emulsion.

12 Claims, No Drawings

DIAZO MICROCAPSULE RECORDING MATERIAL PREPARED USING ION EXCHANGE TREATMENT

BACKGROUND OF THE INVENTION

The present invention relates to a process for the preparation of a heat-sensitive recording material, particularly a diazo-based recording material. More particularly, it is concerned with a process for preparing a diazo-based recording material which causes less formation of background fog.

As a heat-sensitive recording material, a leuco color formation-type heat-sensitive recording material is usually used. Such a recording material, however, has a disadvantage in that rough handling, heating, or contact with solvents after recording causes color formation in unexpected areas, thereby making a recorded image dirty.

In order to develop a heat-sensitive recording material which is free from the above problems, extensive investigations have been made on a diazo color formation-type heat-sensitive recording material in recent years. For example, a heat-sensitive material containing a diazo compound, a coupling component and a basic component (including a precursor substance which becomes basic upon application of heat) in which after heat recording, irradiation with light is applied to decompose an unreacted diazo compound, thereby stopping color formation is disclosed in Japanese Patent Application (OPI) No. 123086/82 (the term "OPI" as used herein means a "published unexamined Japanese patent application"), *Gazo Densi Gakkaishi* (Journal of Image Electronics Association), 11, 290 (1982), and so forth. In accordance with such method, the formation of color in areas where recording is not needed can be stopped (this stopping is hereinafter called "fixation"). In this recording material, however, pre-coupling occurs, causing undesirable color formation, i.e., fog. In order to prevent this pre-coupling, an attempt to prevent contact between components by introducing any one of the color-forming components in the form of non-continuous particles, i.e., solid dispersion has been made. This attempt, however, meets with disadvantages in that not only can the formation of fog not be completely prevented but also heat color forming properties are reduced. As another attempt, a method of minimizing the contact between components by incorporating the diazo compound and the coupling component in different layers is known (see, for example, Japanese Patent Application (OPI) No. 123086/82). This method, however, is not suitable for practical use because although the fog is somewhat reduced, heat color-forming properties are seriously reduced and the recording material cannot respond to high-speed recording having a short pulse width.

As a method permitting the prevention of fog while maintaining heat color forming properties, it is known to encapsulate either the coupling component or the basic substance with a non-polar waxy substance (Japanese Patent Application (OPI) Nos. 44141/82 and 142636/82) or a hydrophobic polymeric substance (Japanese Patent Application (OPI) No. 192944/82) to thereby isolate them from each other. In this encapsulation method, however, the wax or polymeric substance is dissolved in a solvent and then a color-forming component is dissolved or dispersed in the resulting solution to thereby form capsules. These capsules, therefore, are different from those of the usual capsule type. For this reason, when the color-forming component is dissolved, it does not constitute the core of capsules; rather, it uniformly mixes with the encapsulation substance and undergoes pre-coupling in the interface between the capsules, thereby forming fog. When the color-forming component is dispersed, the color-forming reaction does not occur unless the capsule walls are melted by heating, and thus heat color-forming properties are reduced. Furthermore, after formation of capsules, it is necessary to remove the solvent used to dissolve the wax or polymeric substance. This requires an additional step in preparation of capsules and therefore the above method is not sufficiently satisfactory.

In order to overcome the above problems, Japanese Patent Application (OPI) No. 190886/84 discloses a heat-sensitive recording material in which at least one color-forming components is used as the core substance and walls are formed around the core substance by polymerization to achieve microencapsulation.

With conventional capsules, the capsule walls are broken by applying heat or pressure to thereby bring a reactive substance contained in the core of the capsule into contact with another reactive substance outside the capsule, while with the capsules prepared by the above method, the reactive substances present in the core of the capsule and outside the capsule are reacted mainly by allowing them to permeate through the capsule walls by heating.

In this way, color formation can be accomplished by the coupling reaction between the diazo compound and the coupling component according to the above procedure in which the diazo compound is incorporated in the microcapsule and the capsule walls are made to be permeable to the components when heated.

However, in preparing microcapsules containing the diazo compound, some of the diazo compound remains unincluded or unincorporated in the microcapsules and exists in the solution, and this unincluded diazo compound sometimes causes background fog even after preparation of a recording material. To overcome this problem. Japanese Patent Application (OPI) No. 214992/85 laid open on Oct. 28, 1985 corresponding to U.S. patent application Ser. No. 06/721,521 filed Apr. 9, 1985 discloses a method of adding a coupling reaction-deactivating agent to a solution containing the microcapsules. This method, however, is not sufficiently satisfactory.

SUMMARY OF THE INVENTION

The present invention is intended to overcome the above problems and an object of the present invention is to provide a recording material which causes less formation of background fog and has high heat color-forming properties.

It has been found that the object can be attained by removing a diazo compound remaining unincluded in microcapsules formed from an emulsion.

Thus, the present invention relates to a process for preparing a recording material comprising a support and a recording layer on the support, said recording layer containing a coupling component and containing microcapsules containing a diazo compound wherein a microcapsule dispersion which is coated on the support to form the recording layer is prepared by preparing an emulsion containing at least a diazo compound and a microcapsule wall-forming substance, forming microcapsule walls on emulsion droplets, and removing diazo compound remaining unincluded in the microcapsules formed from the emulsion.

DETAILED DESCRIPTION OF THE INVENTION

Diazo compounds which can be used in the present invention include diazosulfonate, diazoaminate, and diazonium salts. Of these compounds, diazonium salts are particularly preferred. Preferred diazo compounds are diazonium salts represented by formula $ArN_2^+X^-$ (wherein Ar is an aromatic portion, $N_2$ is a diazonium group, and $X^-$ is an acid anion), which are capable of forming color undergoing a coupling reaction with a coupling component.

The aromatic portion is preferably the one represented by the following general formula:

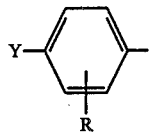

wherein Y is a hydrogen atom, a substituted amino group having 1 to 25 carbon atoms, an alkoxyl group having 1 to 25 carbon atoms, an aryloxy group having 6 to 25 carbon atoms, an arylthio group having 6 to 25 carbon atoms, an alkylthio group having 1 to 25 carbon atoms, or an acylamino group having 1 to 25 carbon atoms, and R is a hydrogen atom, an alkyl group having 1 to 25 carbon atoms, an alkoxyl group having 1 to 25 carbon atoms, an aryloxy group having 6 to 25 carbon atoms, an arylamino group having 6 to 25 carbon atoms, or a halogen atom (e.g., iodine, bromine, chlorine and fluorine).

Preferred examples of the substituted amino group represented by Y are a monoalkylamino group, a dialkylamino group having 2 to 20 carbon atoms, an arylamino group having 6 to 20 carbon atoms, a morpholino group, a piperidino group, and a pyrolidino group.

Representative examples of the salt-forming diazonium are 4-diazo-1-dimethylaminobenzene, 4-diazo-1-diethylaminobenzene, 4-diazo-1-dipropylaminobenzene, 4-diazo-1-methylbenzylaminobenzene, 4-diazo-1-dibenzylaminobenzene, 4-diazo-1-ethylhydroxyethylaminobenzene, 4-diazo-1-diethylamino-3-methoxybenzene, 4-diazo-1-dimethylamino-2-methylbenzene, 4-diazo-1-benzoylamino-2,5-diethoxybenzene, 4-diazo-1-morpholinobenzene, 4-diazo-1-morpholino-2,5-diethoxybenzene, 4-diazo-1-morpholino-2,5-dibutoxybenzene, 4-diazo-1-anilinobenzene, 4-diazo-1-toluylmercapto-2,5-diethoxybenzene, 4-diazo-1,4-methoxybenzoylamino-2,5-diethoxybenzene, and 4-diazo-1-pyrrolidino-2-ethylbenzene.

Representative example of the acid anion are $C_nF_{2n+1}COO^-$ (n is an integer of from 3 to 9), $C_mF_{2m+1}SO_3$ (m is an integer of from 2 to 8), $(ClF_{2l+1}SO_2)_2CH^-$ (l is an integer of from 1 to 18),

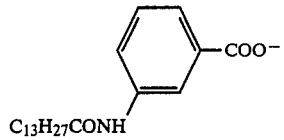

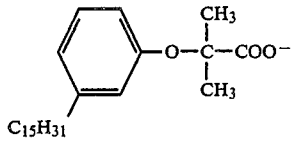

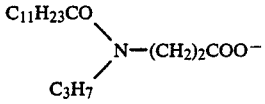

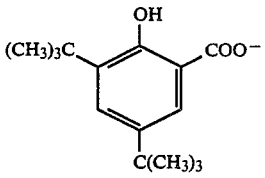

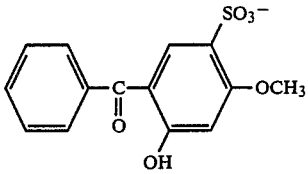

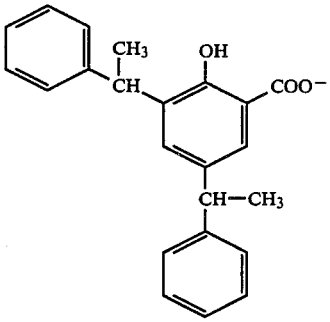

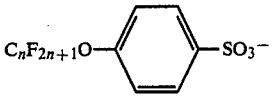

(n is an integer of 3 to 9)

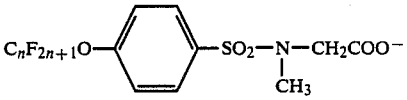

(n is an integer of 3 to 9), $BF_4^-$, and $PF_6^-$.

As the acid anion, those containing a perfluoroalkyl group, a perfluoroalkenyl group, or $PF_6^-$ are preferred in that the increase in fog during the storage of the recording material prior to use, if any is small.

Representative examples of the diazo compound (diazonium slats) are shown below.

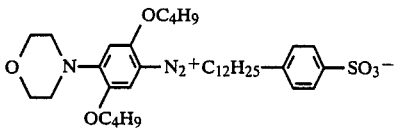

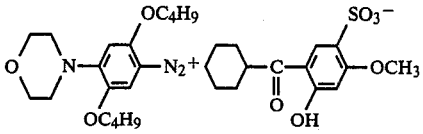

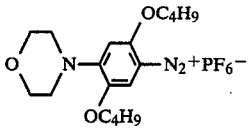

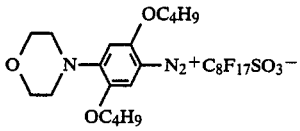

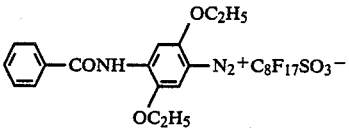

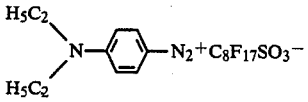

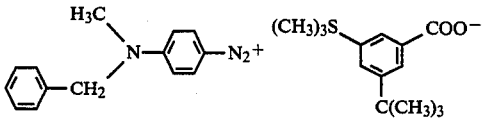

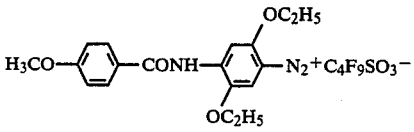

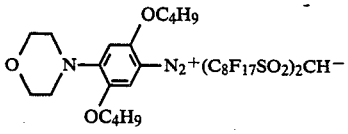

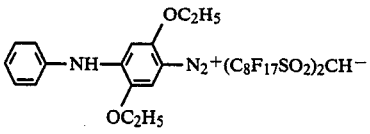

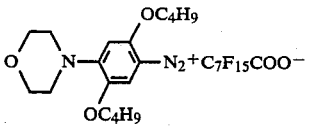

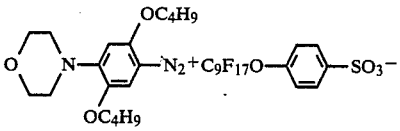

-continued

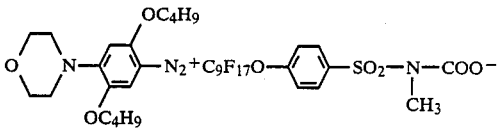

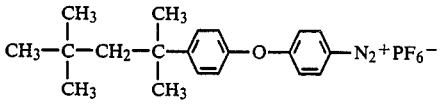

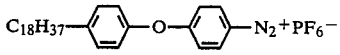

The coupling component that is used in the present invention forms a dye upon coupling reaction with a diazo compound (diazonium salt). These coupling components are divided into two groups: one is such that color formation is accelerated by a basic substance and the other is such that color density is high even in the absence of a basic substance.

Representative examples of coupling components belonging to the former group include resorcin, phloroglucinol, sodium 2,3-dihydroxynaphthalene-6-sulfonate, 1-hydroxy-2-naphthoic acid morpholinopropylamide, 1,5-dihydroxy-6-sulfanilnaphthalene, 2,3-dihydroxynaphthalene, 2,3-dihydroxy-6-sulfanilnaphthalene, 2-hydroxy-3-naphthoic acid anilide, 2-hydroxy-naphthoic acid-methylanilide, 2-hydroxy-3-naphthoic acid ethanolamide, 2-hydroxy-3-naphthoic acid octylamide, 2-hydroxy-3-naphthoic acid tetradecyl amide, acetanilide, acetoacetanilide, benzoylacetanilide, 1-phenyl-3-methyl-5-pyrazolone, 1-(2',4',6'-trichlorophenyl)-3-benzamido-5-pyrazolone, 1-(2',4',6'-trichlorophenyl)-3-anilino-5-pyrazolone, and 1-phenyl-3-phenylacetamido-5-pyrazolone.

Coupling component belonging to the latter group include active methylene compounds, aromatic amine compounds, and aromatic hydroxy compounds containing a basic group in the molecule thereof.

Representative examples of the active methylene compound include $\beta$-ketocarboxylic acid amides (e.g., benzoylacetanilide, pivaloylacetanilide, 1,3-bis(benzoylacetamino)toluene, and 1,3-bis(-pivaloylacetaminomethyl)benzene), pyrazolones (e.g., 3-methyl-1-phenylpyrazolone, 3-hexylcarbamoyl-1-phenylpyrazolone, and 3-myristylamino-1-(2,4,6-trichlorophenyl)pyrazolone, barbituric acids (e.g., 1,3-didodecylbarbituric acid, 1,3-dicyclohexylbarbituric acid, and 1-octyl-3-stearylbarbituric acid), and 1,3-cyclohexanediones (e.g., 5,5-dimethyl-1,3-cyclohexanedione, and 5,5-dimethyl-4-phenyl-1,3-cyclohexanedione).

Representative examples of the aromatic amine compound include $\alpha$-naphthylamine, $\beta$-naphthylamine, 1-anilino-naphthalene, 2-anilinonaphthalene, 3-aminodiphenylamine, 4,4'-diaminodiphenylmethane, N,N-dicyclohexylaniline, 2-aminocarbazole, 2-phenylindole, 1-phenyl-2-methylindole, and aromatic amine organic acid salts and inorganic acid salts such as p-toluenesulfonate of N,N-dimethylaniline and $\alpha$-naphthylamine hydrochloride.

Representative examples of the aromatic hydroxy compound containing a basic group in the molecule thereof include 2-hydroxy-3-naphthoic acid-3'-morpholinopropylamide, 2-hydroxy-3-naphthoic acid-2'- diethylaminoethylamide, 2-hydroxy-3-naphthoic acid-3-piperidinopropylamide, 2-hydroxy-3-naphthoic acid-3'-piperidinopropylamide, 2-hydroxy-3-naphthoic acid-p-(3'-N'-cyanoguanidinopropyloxyanilide, salicylic acid-p-(3'-morpholinopropyl)oxyanilide, 1-naphthol-4-sulfonic acid-3'-diethylaminopropylamide, 8-hydroxyquinoline-4-sulfonic acid-2'-diethylaminoethylamide, and aromatic hydroxyl compounds containing a radical releasing a basic group on heating, such as organic caboxylic acid salts of amines (e.g., trichloroacetic acid salt of 2-hydroxy-3-naphthoic acid-3'-morpholinopropylamide and phenylthioacetic acid salt of 1-naphthol-4-sulfonic acid-3'-diethylaminopropylamide).

Using two or more of these coupling components in combination, an image of any desired color can be obtained.

Microcapsules of the present invention are prepared by emulsifying a diazo compound, an organic solvent and a microcapsule wall-forming substance to prepare oil droplets and then forming walls of a polymeric substance around the droplets. Microencapsulation methods which can be used in the present invention are described, e.g., in British Pat. No. 990,443, U.S. Pat. Nos. 3,287,154, 3,726,804 and 3,796,669. It is preferred for the microcapsule wall-forming substance to be added to the inside of the droplets, but the substance may be added to the outside of the droplets. Representative examples of the polymeric substance are polyurethane, polyurea, polyamide, polyester, polycarbonate, a urea-formaldehyde resin, a melamine resin, polystyrene, a styrene-methacrylate copolymer, a styrene-acrylate copolymer, gelatin, polyvinyl pyrrolidone and polyvinyl alcohol.

These polymeric substances can be used as mixtures comprising two or more thereof.

Of the above polymeric substances, polyurethane, polyurea, polyamide, polyester, and polycarbonate are preferred. Particularly preferred are polyurethane and polyurea.

For the preparation of microcapsules according to the present invention, it is effective to use a method in which microencapsulation is accomplished by polymerization of a reactant from the inside of emulsified droplets. That is, in accordance with this method, there can be obtained in a short time microcapsules which have a uniform particle size and provide a recording material excellent in the storage stability prior to use.

The above encapsulation method and representative compounds are described in U.S. Pat. Nos. 3,726,804 and 3,796,669.

For example, in a case where polyurethane is used as a capsule wall-forming material, a polyvalent isocyanate and a second substance (e.g., polyol) capable of forming capsule walls on reacting with the polyvalent isocyanate are mixed with a oily liquid to be encapsulated, the resulting mixture is emulsified in water and then the temperature is raised to thereby cause a polymer-forming reaction in the interface between oil droplets, whereupon the microcapsule walls are formed. In this case, an auxiliary solvent having a low boiling point and a high dissolving power can be added to the oily liquid.

Polyisocyanates, and polyols and polyamines which react with the polyisocyanates as described in U.S. Pat. Nos. 3,281,383, 3,773,695, 3,793,268, Japanese Patent Publication Nos. 40347/73, 24159/74, Japanese Patent Application (OPI) Nos. 80191/73 and 84086/73 can be used.

To accelerate the above urethanation reaction, tin salts such as dibutyl thin dilaurate, for example, can be used in combination.

In particular, when a polyvalent isocyanate is used as the first wall-forming substance and a polyol as the second wall-forming substance, the resulting material has good storage stability prior to use. By suitably choosing a combination of the two compounds, the heat permeability of the reactive substance can be changed as desired. The method of forming capsule walls is not limited to that described above. In addition, polymeric substances formed by reaction of polyvalent isocyanate and polyol are preferably used in the present invention. By suitably choosing a combination of polyvalent isocyanate and polyol, the glass transition point of the resulting capsule walls can be changed.

Typical examples of the polyvalent isocyanate include diisocyanates such as m-phenylenediisocynate, p-phenylenediisocyanate, 2,6-tolylenediisocyanate, 2,4-tolylenediisocyanate, naphthalene-1,4-diisocyanate, diphenylmethane-4,4'-diisocyanate, 3,3'-dimethoxy-4,4'-biphenyldiisocyanate, 3,3'-dimethyldiphenylmethane-4,4'-diisocyanate, xylylene-1,4-diisocyanate, 4,4'-diphenylpropanediisocyanate, trimethylenediisocyanate, hexamethylenediisocyanate, propylene-1,2-diisocyanate, butylene-1,2-diisocyanate, cyclobutylene-1,2-diisocyanate, and cyclohexylene-1,4-diisocyanate; triisocyanates such as 4,4',4''-triphenylmethane-triisocyanate and toluene-2,4,6-triisocyanate; tetraisocyanates such as 4,4'-dimethyldiphenylmethane-2,2',5,5'-tetraisocyanate; and isocyanate prepolymers such as a 2,4-tolylenediisocyanatetrimethylolpropane adduct, a xylylene diisocyanatetrimethylolpropane adduct, and a tolylenediisocyanate-hexanetriol adduct.

Representative examples of the polyol include aliphatic and aromatic polyvalent alcohols, hydroxypolyesters, and hydroxypolyalkylene ether. Preferred examples of the polyol are polyhydroxy compounds containing a group represented by the formula (I), (II), (III) or (IV) between two hydroxyl groups, and having a molecular weight of not more than 5,000.

(I) Aliphatic hydrocarbon group having from 2 to 8 carbon atoms.

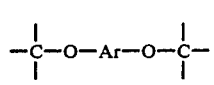
(II)

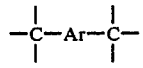
(III)

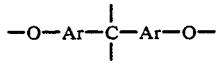
(IV)

The symbol Ar in the above formulae (II), (III) and (IV) represents a substituted or unsubstituted aromatic group, and the aliphatic hydrocarbon group of formula (I) has a fundamental skeleton of $-C_nH_{2n}-$ in which other groups may be substituted for one or more of the hydrogen atoms.

Representative examples of formula (I) include ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, phenylethylene glycol, 1,1,1-trimethylolpropane, hexanetriol, pentaerythritol, and glycerol.

Representative examples of formula (II) are condensates of aromatic polyvalent alcohols (e.g., 1,4-di(2-hydroxyethoxy)benzene and resorcinol dihydroxyethyl ether) and alkylene oxide.

Representative examples of formula (III) are p-xylylene glycol, m-xylylene glycol, and $\alpha,\alpha'$-dihydroxy-p-diisopropylbenzene.

Representative examples of (IV) include 4,4'-dihydroxydiphenylmethane, 2-(p,p'-dihydroxydiphenylmethane)benzyl alcohol, a bisphenol A-ethylene oxide adduct, and a bis-phenol A-propylene oxide adduct. It is preferred for the polyol to be used in such an amount that the molar ratio of the hydroxyl group to the isocyanate group is from 0.02/1 to 2/1.

In place of polyol, polyamine can be used. Representative examples of such polyamides are ethylenediamine, trimethylenediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentaamine, and an epoxy compound-amine adduct.

When the amounts of polyisocyanate, polyamine and polyol being added are changed, provided that the other conditions are the same, the wall thickness varies. Also, the particle size can be changed by changing the degree of agitation at the time of dispersion and emulsification. Therefore, as long as the remaining conditions are the same, only the wall thickness can be changed.

In preparing microcapsules, water-soluble polymers can be used. As the water-soluble polymer, any of water-soluble anionic polymers, nonionic polymers and amphoteric polymers can be used. As the anionic polymers and amphoteric polymers can be used. As the anionic polymers, natural and synthetic polymers can be used. Examples are polymers having groups such as $-COO^-$ and $-SO_3^-$. Representative examples of anionic natural polymers are gum arabic and alginic acid, and representative examples of half-synthetic polymers include carboxy-methyl cellulose, phthalated gelatin, saulfated starch, sulfated cellulose, and lignin-sulfonic acid.

Representative examples of the synthetic polymer include a maleic anhydride copolymer (including compounds resulting from hydrolysis of the copolymers), an acrylic acid (including methacrylic acid) homo- or copolymer, a vinylbenzene-sulfonic acid homo- or copolymer, and a carboxyl-modified polyvinyl alcohol.

Representative examples of the nonionic polyer are polyvinyl alcohol, hydroxyethyl cellulose and methyl cellulose.

An example of the amphoteric polymer is gelatin.

These water-soluble polymers are used as a 0.01 to 10 wt% aqueous solution. The average particle size (arithmetic mean diameter) of microcapsules is adjusted to not more than 20 $\mu$m. In general, if the average particle size is in excess of 20 $\mu$m, the quality of print is poor.

In a case where heating with a thermal head is applied on a surface of the coating, the average particle size is preferably not more than 8 $\mu$m in order to avoid pressure fog.

Of the main components as used herein, i.e., the diazo compound, the coupling component, and the basic substance as used if necessary, the diazo compound is used as a core substance of microcapsules. The other two components may be present inside the core of the same or other microcapsules, or may otherwise be present outside of the microcapsules containing the diazo compound. In a case in which the diazo compound and one other component are incorporated in microcapsules, they may be present in the same microcapsules or in different microcapsules. In a case in which both of the other two components are incorporated in microcapsules, all the three components cannot be incorporated in the same microcapsules, but various combinations can be employed (of course, if the coupling component undergoes a coupling reaction in the absence of the basic substance, the diazo compound and the coupling component cannot be incorporated in the same microcapsules). Other components not included in the core of the microcapsules are used outside the microcapsules in the recording layer.

In preparing the microcapsules, they can be prepared using an emulsion containing not less than 0.2 wt% of a component to be microencapsulated.

It is preferred for the coupling component and the basic substance used if necessary in the present invention to be used in amounts of from 0.1 to 10 parts by weight, and in an amount of up to 20 parts by weight, respectively, both being per part by weight of the diazo compound, regardless of whether they are incorporated in the inside of the microcapsules or in the heat-sensitive layer outside the microcapsules. The diazo compound is preferably coated in an amount of from 0.05 to 5.0 $g/m^2$.

When the coupling component and the basic substance as used are not microencapsulated, it is preferred that they be dispersed in a solid form in combination with a water-soluble polymer by the use of, e.g., a sand mill. Water-soluble polymers preferably used in this case are the same as used in preparing the microcapsules. The concentration of the water-soluble polymer is from 2 to 30 wt%. The coupling component and the basic substance are added each in an amount of from 5 to 40 wt% to the water-soluble polymer solution.

The dispersed particle size is preferably not more than 10 $\mu$m.

In accordance with the process of the present invention, the diazo compound to be used as the core substance of the microcapsules is dissolved or dispersed in an organic solvent immiscible with water, and then microcapsule walls are formed around droplets by polymerization. As the organic solvent, those having a boiling point of not less than 180° C. are preferred. For example, phosphoric acid esters, phthalic acid esters, other carboxylic acid esters, fatty acid amides, alkylated biphenyls, alkylated terphenyls, chlorinated paraffin, alkylated naphthalenes, and diarylethanes can be used. Representative examples include tricresyl phosphate, trioctyl phosphate, octyl diphenyl phosphate, tricyclohexyl phosphate, dibutyl phthalate, dioctyl phthalate, dilauryl phthalate, dicyclohexyl phthalate, butyl oleate, diethylene glycol dibenzoate, dioctyl sebacate, dibutyl sebacate, dioctyl adipate, trioctyl trimellitate, acetyl triethyl citrate, octyl maleate, dibutyl maleate, isopropyl biphenyl, isoamyl biphenyl, chlorinated paraffin, diisopropyl-naphthalene, 1,1'-ditolylethane, 2,4-di-tert-amylphenol, and N,N-dibutyl-2-butoxy-5-tert-octylaniline.

Of these compounds, ester solvents such as dibutyl phthalate, tricresyl phosphate, diethyl phthalate, and dibutyl maleate are particularly preferred.

It is preferred for the recording material of the present invention to contain a basic substance and/or a color formation-accelerating substance. The basic substance accelerates the reaction of the diazo compound and the coupling component.

As the basic substance, sparingly water-soluble or water-insoluble basic substances, or substances releasing an alkali on heating are used.

The basic substance includes nitrogen-containing compounds such as inorganic or organic ammonium salts, organic amines, 2-aminothiazoles, pyrimidines, piperazines, guanidines, imidazoles, imidazolines, morpholines, piperidines, amidines, azines and pyridines. Representative examples include ammonium acetate, tricyclohexylamine, tribenzylamine, octadecylbenzylamine, stearylamine, 2-benzylimidazole, 4-phenylimidazole, 2-phenyl-4-methylimidazole, 2-undecylimidazoline, 2,4,5-trifuryl-2-imidazoline, 1,2-diphenyl-4,4-dimethyl-2-imidazoline, 2-phenyl-2-imidazoline, 1,2,3-triphenylguanidine, 1,2-ditolyl-guanidine, 1,2-dicyclohexylguanidine, 1,2,3-tricyclohexylguanidine, guanidine trichloroacetate, N,N'-dibenzylpiperazine, 4,4'-dithiomorpholine, morpholinium trichloroacetate, 2-aminobenzylthiazole, and 2-benzoylhydrazinobenzothiazole.

These basic substances can be used as mixtures comprising two or more thereof.

Color formation-accelerating agents which can be used include hydroxyl compounds, carbamic acid esters, aromatic methoxy compounds, and organic sulfonamide compounds. The color formation-accelerating agent is considered to lower the melting point of the coupling component or the basic substance, or to increase heat permeation properties of the microcapsule walls, thereby increasing the practical density.

Representative examples of the hydroxyl compound are phenol compounds such as p-tert-butylphenol, p-tert-octylphenol, p-α-cumylphenol, p-tert-pentylphenol, m-xylenol, 2,5-dimethylphenol, 2,4,5-trimethylphenol, 3-methyl-4-isopropylphenol, p-benzylphenol, o-cyclohexylphenol, p-(diphenylmethyl)phenol, p-(α,α-diphenylethyl)phenol, o-phenylphenol, ethyl p-hydroxybenzoate, propyl p-hydroxybenzoate, butyl p-hydroxybenzoate, benzyl p-hydroxybenzoate, p-methoxyphenol, p-butoxyphenol, p-heptyloxyphenol, p-benzyloxyphenol, dimethylvaniline 3-hydroxyphthalate, 1,1-bis(4-hydroxyphenyl)dodecane, 1,1-bis(4-hydroxyphenyl)-2-ethylhexane, 1,1-bis(4-hydroxyphenyl)-2-methylpentane, 2,2-bis(4-hydroxyphenyl)peptanevaniline, 2-tert-butyl-4-methoxyphenol, 2,6-dimethoxyphenol, and 2,2'-dihydroxy-4-methoxybenzophenone; and alcohol compounds such as 2,5-dimethyl-2,5-hexanediol, resorcinol di(2-hydroxyethyl)ether, resorcinol mono(2-hydroxyethyl)ether, salicylic alcohol, 1,4-di(-hydroxyethoxy)benzene, p-xylylenediol, 1-pheyl-1,2-ethanediol, diphenylmethanol, 1,1-diphenylethanol, 2-methyl-2-phenyl-1,3-propanediol, 2,6-dihydroxymethyl-p-cresol benzyl ether, 2,6-dihydroxymethyl-p-cresol benzyl ether, and 3-(o-methoxyphenoxy)-1,2-propanediol.

Representative examples of the carbamic acid ester include N-phenylcarbamic acid ethyl ester, N-phenylcarbamic acid benzyl ester, N-phenylcarbamic acid phenetyl ester, carbamic acid benzyl ester, carbamic acid butyl ester, and carbamic acid isopropyl ester.

Representative examples of the aromatic methoxy compound include 2-methoxybenzoic acid, 3,5-dimethoxyphenylacetic acid, 2-methoxynaphthalene, 1,3,5-trimethoxybenzene, p-dimethoxybenzene, and p-benzyloxymethoxybenzene.

Representative examples of the organic sulfonamide compound are p-toluenesulfonamide, o-toluenesulfonamide, benzenesulfonamide, p-toluenesulfonanilide, N-(p-methoxyphenyl)-p-toluenesulfonamide, N-(o-methoxyphenyl)-p-toluensulfonamide, N-(p-chlorophenyl)-p-toluenesulfonamide, N-(o-chlorophenyl)-p-toluenesulfonamide, N-(p-tolyl)-p-toluenesulfonamide, N-(o-tolyl)-p-toluenesulfonamide, N-(o-hydroxyphenyl)-p-toluenesulfonamide, N-benzyl-p-toluenesulfonamide, N-(2-phenethyl)-p-toluenesulfonamide, N-(2-hydroxyethyl)-p-toluenesulfonamide, N-(3-methoxypropyl)-p-toluenesulfonamide, methanesulfonanilide, N-(p-tolyl)sulfonamide, N-(o-tolyl)sulfonamide, N-(p-methoxyphenyl)sulfonamide, N-(o-methoxy)sulfonamide, N-(p-chlorophenyl)sulfonamide, N-(o-chlorophenyl)sulfonamide, N-(2,4-xylyl)sulfonamide, N-(p-ethoxyphenyl)sulfonamide, N-benzylmethanesulfonamide, N-(2-phenoxyethyl)mechanesulfonamide, 1,3-bis(methanesulfonylamino)benzene, and 1,3-bis(p-toluenesulfonylamino)propane.

These compounds can be used to form microcapsules along with the core substance thereof, or can be added to a coating liquid for the heat-sensitive recording material so as to exist outside the capsules. It is preferred, however, that they be dispersed in a solid form separately so as to exist outside the microcapsules. In any case, the amount of the basic substance used is usually from 0.01 to 1 part by weight and preferably from 0.01 to 0.2 part by weight per part by weight of the capsule wall-forming material. However the amount of the basic substance can be chosen appropriately to control the color density.

In accordance with the process of the present invention, the diazo compound remaining uncontained in microcapsules in preparation of the microcapsules are removed. This removal can be carried out by techniques such as filtration treatment, ion exchange treatment, electrophoresis treatment, chromatographic treatment, gel permeation treatment, dialysis treatment, and adsorption treatment such as using activated carbon.

The above treatment permits to remove the diazo compound remaining in a crystal form or dissolved in the dispersion medium without being contained in the microcapsules, which is responsible for background fog. Thus the background fog can be greatly decreased.

For the simple filtration treatment, various filters such as gauge, nylon mesh cloth, metallic mesh, and microfilters can be used.

In the ion exchange treatment, cationic exchange materials having a phosphoric acid group, a carboxylic acid group, or a sulfonic acid group, for example, in the side chain, and anionic exchange materials having an amino group, or an ammonium group, for example, in the side chain can be used alone or in combination with each other.

Typical examples are Amberlite IR-120, Amberlite IR-120B, Amberlite IR-118, Amberlite IR-121, Amberlite IR-122, Amberlite IR-124, Amberlite 200C, amberlist 15, amberlist XN-1004, Amberlite XN-1005, Amberlist A-26, Amberlist A-27, Amberlite A-21, and Amberlite LA-1 (product of Rhom & Haas Co., Ltd.).

Preferably the cationic ion exchange material is used alone or in combination with the anionic ion exchange material.

In carrying out the ion exchange treatment, for example, a method in which an ion exchange resin is added to a microcapsule-containing dispersion, stirred, allowed to stand for a sufficiently long time, and then the ion exchange resin is removed, or a method in which an ion exchange resin is packed in a column and the microcapsule-containing dispersion is passed through the column.

In addition, ion exchange membranes marketed under the trademarks ASIPUREX K-lol (produced by Asahi Kasei Kogyo Co., Ltd.), SEMIREON CMV, SEMIREON AMV (produced by Asahi Garasu Co., Ltd.), NEOSEPUTA CL-25T, NEOSEPUTA AV-4T (produced by Tokuyama Soda Co., Ltd.), AMF Ion C-60, AMF Ion A-60 (produced by AMF Co., Ltd.) and the like can be used.

In the dialysis treatment, dialysis membranes such as Visking Cellulose Tube (produced by Union Carbide Corp.) can be used. The microcapsule-containing dispersion is placed in one side of the dialysis membrane, and the dialysis is carried out by known techniques.

In the treatment using activated carbon, activated carbon (produced by Kanto Kagaku Co., Ltd.) is added to the microcapsule-containing dispersion and then, after stirring the resulting mixture, the activated carbon is removed by filtration.

The above treatment is known in the art and is described in various literatures. For example, the ion exchange treatment is described in *Shin Jikken Kagaku Koza,* 1, *Kihon Sosa (I)*, Maruzen Co., Ltd., (1975), pp. 463–497; the ion exchange treatment is described in the same reference as above, pp. 498–500; and the electrophoresis is described in also the same reference as above, pp. 501–511.

The reverse osmotic method is described in *Shin Jikken Kagaku Koza,* 19, *Kobunshi Kagaku (II)*, Maruzen Co., Ltd. (1975), pp. 969–989, and the ultrafiltration method is described in ibid., pp. 989–998.

The process of the present invention can be carried out by using a microcapsule dispersion prepared according to the present invention in conjunction with the techniques described in the above literature.

In a case where only a simple filtration treatment is applied, only diazonium salt particles in the crystalline form in the dispersant can be removed, and therefore the background fog can be reduced only to a limited extent.

Of the above treatments, the ion exchange treatment, the reverse osmotic treatment, the ultrafiltration treatment, and the dialysis treatment are preferably used. In particular, the treatment using a cationic exchange resin, or a combination of a cationic exchange resin and an anionic exchange resin is preferred.

The above treatment may be carried out after the formation of the microcapsules but before mixing with other additives, or at a stage that a coating liquid is prepared by mixing with additives such as the coupling component, the basic substance, and the color formation-accelerating substance. It is preferred, however, that the treatment be carried out before combining the microcapsules, the coupling component and the basic substance or color formation-accelerating agent. It is particularly preferred that the treatment be applied after the formation of the microcapsules but before mixing with other additives.

To the recording material of the present invention can be added a free radical generating agent (compound releasing a free radical upon irradiation with light) which is used in photopolymerizable compositions and so on for the purpose of reducing yellow-coloration of background areas after light fixation. Free radical generating agents which can be used include aromatic ketones (e.g., benzophenone, 4,4'-bis(dimethylamino)benzophenone, 4,4'-bis(diethylamino)benzophenone, 4-methoxy-4'(dimethylamino)benzophenone, 4,4'-dimethoxybenzophenone, 4-dimethylaminobenzophenone, 4-methoxy-3,3'-dimethylbenzophenone, 1-hydroxycyclohexylphenylketone, 4-dimethylaminoacetophenone, 2-methyl-1-(4-methylthio)phenyl)-2-morpholinopropanone-1-acetophenone, benzyl); cyclic aromatic ketones (e.g., fluorenone, anthrone, xanthone, thioxanthone, 2-chlorothioxanthone, 2,4-dimethylthioxanthone, 2,4-diethylthioxanthone, acridone, N-ethylacridone, and benzanthrone); quinones (e.g., benzoquinone, 2,3,5-trimethyl-6-bromobenzoquinone, 2,6-di-n-decylbenzoquinone, 1,4-naphthoquinone, 2-isoproxy-1,4-naphthoquinone, 1,2-naphthoquinone, anthraquinone, 2-chloroanthraquinone, 2-methylanthraquinone, 2-tert-butylanthraquinone, and phenanthraquinone); benzoin and benzoin ethers (e.g., benzoin methyl ether, benzoin ethyl ether, 2,2-dimethoxy-2-phenylacetophenone, and α-methylol-benzoin methyl ether); aromatic polycyclic hydrocarbons (e.g., naphthalene, anthrathene, phenanthrene, and pyrene); azo compounds (e.g., azobisisobutyronitrile, α-azo-1-cyclohexanecarbonitrile, and azobisvaleronitrile); organic disulfides (e.g., thiuramidisulfide); and acyloxime esters (e.g., benzyl-(o-ethoxycarbonyl)-α-monooxime).

The amount of the free radical generating agent used is preferably from 0.01 to 5 parts by weight, more preferably from 0.1 to 1 part by weight per part by weight of the diazonium compound.

By incorporating the free radical generating agent in combination with the diazonium salt as the core substance of microcapsules, yellow coloration of background areas after light fixation can be reduced.

In the recording material of the present invention, polymerizable compounds containing an ethylenically unsaturated bond (hereinafter called a "vinyl monomer") can be used for the purpose of reducing the yellow coloration of background areas after light fixation. This vinyl monomer is a compound containing at least one ethylenically unsaturated bond (e.g., a vinyl group and a vinylidene group) in the chemical structure thereof, and takes a chemical form such as a monomer, a prepolymer, e.g., a dimer, a trimer and an oligomer, or a mixture thereof, or a copolymer thereof. Examples are unsaturated carboxylic acids or their salts, esters of unsaturated carboxylic acids and aliphatic polyhydric alcohol compounds, and amides of unsaturated carboxylic acids and aliphatic polyvalent amine compounds.

The amount of the vinyl monomer used is from 0.2 to 20 parts by weight, preferably from 1 to 10 parts by weight per part by weight of the diazo compound.

The vinyl monomer is used in combination with the diazo compound as the core substance of microcapsules. In this case, a part or whole or an organic solvent to be used as a solvent for the core substance (or dispersion medium) can be replaced with vinyl monomer. However it is not necessary for the vinyl monomer to be added to such an extent as to cause hardening of the core substance.

In the recording material of the present invention, a coupling reaction-inactivating agent may be incorporated outside the microcapsules. This agent reacts with a diazonium compound remaining unremoved after the removal of the diazonium compound from an aqueous layer or diazonium compound in incomplete capsules (i.e., a diazonium compound incompletely blocked with capsule walls), making the diazo compound unable to cause the coupling reaction (color formation reaction). As the coupling reaction-inactivating agent, any substance can be used as long as they are capable of reducing the coloration of a solution containing the diazo compound. It can be easily tested if or not a substance has an inactivation ability. That is, a diazo compound is dissolved in water or an organic solvent, the substance which has been dissolved in water or an organic solvent is added to the diazo compound solution, and a change in color of the resulting mixture is examined.

Representative examples of the inactivation agent are hydroquinone, sodium hydrogensulfite, potassium nitrite, hypophosphorous acid, stannous chloride, formalin, sodium hydrosulfite, hydrazine, hydrazine derivatives, hydroxylamine, and hydroxylamine derivatives. In addition, compounds described in K. H. Sawnders, *The Aromatic Diazo Compounds and Their Technical Applications.* M.C., M.A. (Cant ab.) B.Sc. (London), published 1949, pp. 105–306 can be used.

The coupling reaction-inactivating agent is preferably such as to be less colored by itself and to exert less adverse influences. More preferred are water-soluble substances.

The coupling reaction-inactivating agent is used to such an extent as not to prevent the heat color formation reaction of the diazo compound. Usually the inactivation agent is used in an amount of from 0.01 to 2 mol per mol of the diazo compound. More preferably the amount of the inactivation agent used from is 0.02 to 1 mol per mol of the diazo compound.

The coupling reaction-inactivating agent of the present invention can be used in the following manners. It can be added to a liquid in which microcapsules containing the diazo compound are dispersed; it can be added to a liquid in which a coupling agent or a basic substance is dispersed; or it can be added to a liquid in which a mixture of the coupling agent and the basic substance is dispersed. It is preferred for the inactivation agent to be used in the form of an aqueous solution.

In the recording material of the present invention, for the purpose, e.g., of preventing sticking to a thermal head or improving writing properties, fine powders, e.g., of pigments such as silica, barium sulfate, titanium oxide, aluminum hydroxide, zinc oxide, and calcium carbonate, and resins such as styrene beads, a urea-melamine resin, and the like can be used.

In addition, for the purpose of preventing sticking, metal soaps, for example, can be used. The amount of the compound used is generally from 0.2 to 7 g/m$^2$.

In the recording material of the present invention, a heat-meltable substance can be used for the purpose of increasing a heat recording density. This heat-meltable substance is a substance having a melting point of from about 50° to 150° C., which is solid at ordinarily temperature and melts on heating with a thermal head, and is a substance capable of dissolving the diazo compound, the coupling component or the basic substance. The heat-meltable substance is dispersed in a granular form of from 0.1 to 10 μm and used in an amount (calculated as solids) of from 0.2 to 7 g/m$^2$. Representative examples of the heat-meltable substance are fatty acid amides, N-substituted fatty acid amides, ketone compounds, urea compounds, and esters.

In the recording material of the present invention, coating is carried out using a suitable binder.

As the binder, various emulsions of e.g., polyvinyl alcohol, methyl cellulose, carboxymethyl cellulose, hydroxy-propyl cellulose, gum arabic, gelatin, polyvinyl pyrrolidone, casein, a styrene-butadiene latex, an acrylonitrile-butadiene latex, polyvinyl acetate, polyacrylate, and an ethylene-vinyl acetate copolymer can be used. The amount of the binder used is, calculated as solids, from 0.5 to 5 g/m$^2$.

In addition to the above ingredients, as an acid stabilizer, citric acid, tartaric acid, oxalic acid, boric acid, phosphoric acid, and pyrophosphoric acid can be used.

The recording material of the present invention is prepared as follows:

A coating solution containing a diazo compound and a coupling component as the main components, a basic substance, a color formation-accelerating substance and other additives if desired is first prepared. This coating solution is then coated on a support such as paper and a synthetic resin film by coating techniques such as bar coating, blade coating, air knife coating, gravure coating, roll coating, spray coating, and dip coating. The coating thus formed is dried to form a heat-sensitive layer having a solids content of from 2.5 to 25 g/m$^2$.

The following procedure can also be used.

The coupling component, the basic substance, the color formation-accelerating substance and other additives are added as the core substance of microcapsules, or dispersed in a solid form, or dissolved as an aqueous solution. Then a coating liquid is prepared, and it is coated on a support and dried to form a precoat layer having a solid content of from 2 to g/m$^2$. Then a coating liquid containing the diazo compound and other additives is coated and dried to form a coating layer having a solid content of from 1 to 15 g/m$^2$. In this way, a lamination-type recording material is prepared. In this material, the order of the above layers may be changed. Furthermore, the type and composition of the components may be changed. As the coating method, successive coating or simultaneous coating can be used. This lamination-type recording material is excellent in long-term storage stability.

Furthermore, the heat-sensitive layer may be provided after formation of an intermediate layer as described, e.g., in Japanese Patent Application No. 177669/84 on the support.

As the paper to be used as the support, a neutral paper (as described in Japanese Patent Application (OPI) No. 14281/80) which is subjected to sizing with a neutral sizing agent and having a heat extraction pH of from 6 to 9 is advantageous to use in that it is excellent in storage stability for a long period of time.

In order to prevent permeation of the coating liquid into the paper, or to improve contact between a recording thermal head and the heat-sensitive recording layer, it is advantageous to use paper as described in Japanese Patent Application (OPI) No. 116687/82, satisfying the following equation:

$$\frac{\text{Stockigt sizing degree}}{(\text{Meter Basis Weight})^2} \geqq 3 \times 10^{-3}$$

and further having a Beck smoothness of more than 90 seconds.

In addition, paper having an optical surface roughness of less than 8 μm and a thickness of from 40 to 75 μm as described in Japanese Patent Application (OPI) No. 136492/83, paper having a density of less than 0.9 g/cm$^3$ and an optical contact ratio of more than 15% as described in Japanese Patent Application (OPI) No. 69091/83, paper prepared from pulp produced by beating to such an extent that the Canadian standard freeness (JIS P8121) is more than 400 cc, and designed to prevent permeation of the coating solution as described in Japanese Patent Application (OPI) No. 69097/83, paper produced with a Yankee machine in which a luster surface of the original paper is used as a coating layer and improved in color density and resolving power, as described in Japanese Patent Application (OPI) No. 65695/83, and paper which is improved in coating suitability by applying corona discharge treatment, as described in Japanese Patent Application (OPI) No. 35985/84 can provide good results.

Moreover, any supports commonly used in the field of usual heat-sensitive recording papers can be used in the present invention.

The recording material of the present invention can be used as a printer paper for use with facsimile equipment and with an electronic computer for which high-speed recording is needed. Moreover, the fixation can be carried out by decomposing an unreacted diazo compound through exposure to light after heat printing. In addition, the recording material of the present invention can be used as a heat development-type copying paper.

The present invention is described below in greater detail with reference to the following examples. All parts are by weight.

EXAMPLE

First, the following component dispersions were prepared, and then the coating dispersions shown in Table 1 were prepared.

The coating liquid thus prepared was coated on a paper support by use of #20 coating wire bar and dried with air to prepare a recording material.

Capsule Dispersion A

| | |
|---|---|
| Diazo compound 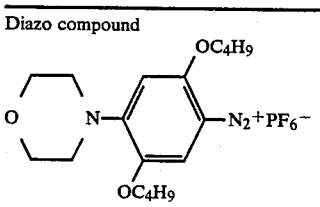 | 5.1 parts |
| Tricresyl phosphate | 6 parts |
| Methylene chloride | 12 parts |
| Trimethylolpropane trimethacrylate | 18 parts |
| TAKENEITO D-11ON (trimethylolpropane xylylenediisocyanate (1 mol:3 mol) adduct, 75 wt % ethyl acetate solution, produced by Takeda Yakuhin Kogyo Co., Ltd.) | 24 parts |

The above compounds were mixed and then added to the following solution:

| | |
|---|---|
| Aqueous polyvinyl alcohol solution (8 wt % solution) | 63 parts |
| Distilled water | 100 parts |

The resulting mixture was emulsified at 20° C. to prepare an emulsion having an average particle diameter of 2 μm. This emulsion was stirred at 40° C. for 3 hours.

The solution thus prepared was cooled to 20° C. to prepare the capsule dispersion A.

Capsule Dispersion B

The capsule dispersion A was filtered using a 100 mesh Nylon mesh to obtain the capsule dispersion B.

Capsule Dispersion C

To the capsule dispersion A was added 100 cc of Amberlite IR-120B (produced by Rhom & Haas Co.), and the resulting mixture was stirred for 1 hour and then filtered to obtain the capsule dispersion C.

Capsule Dispersion D

To the capsule dispersion A were added Amberlite IB-120B and Amberlite IRA-400 (produced by Rhom & Haas Co.) each in an amount of 100 cc. The resulting mixture was stirred for 1 hours and then filtered to obtain the capsule dispersion D.

Basic Substance Dispersion

| | |
|---|---|
| Base triphenylguanidine | 42 parts |
| Aqueous polyvinyl alcohol solution (6.7 wt %) | 124 parts |

The foregoing were mixed and dispersed with Daino Mill (produced by Willy A. Bachofen A.G.) to obtain a basic substance dispersion having an average particle diameter of 3 μm.

Color Formation-Accelerating Agent Dispersion

| | |
|---|---|
| Color formation-accelerating agent 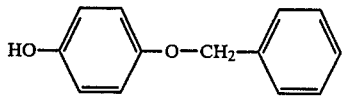 | 42 parts |
| Aqueous polyvinyl alcohol solution (6.7 wt %) | 124 parts |

The foregoing were mixed and dispersed with a Daino Mill to obtain a color formation-accelerating agent dispersion having an average particle diameter of 3 μm.

Coupling Component Dispersion

| | |
|---|---|
| Coupling component 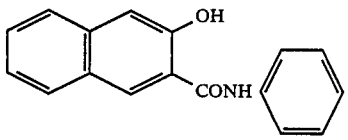 | 29 parts |
| Aqueous polyvinyl alcohol solution (4 wt %) | 138 parts |

The foregoing were mixed and dispersed with a Daino Mill to obtain a coupling component dispersion having an average particle diameter of 3 μm.

Pigment Dispersion A

Unibar 70 (produced by Siraishi Kogyo Co., Ltd.) was dispersed with a Daino Mill so that a 40 wt% dispersion was obtained, and designated as pigment dispersion A.

Pigment Dispersion B

HAIDORIN Z-7 (trademark for 30 wt% solution, produced by Chukyo Yushi Co., Ltd.) was used as the pigment dispersion B.

Pigment Dispersion C

SEROSOL D-130 (trademark for 22 wt% solution produced by Chukyo Yushi Co., Ltd.) was used as the pigment dispersion C.

TABLE 1

| | Cotaing Composition | | | |
|---|---|---|---|---|
| Component Dispersion | Com. Example 1 | Example 1 | Example 2 | Example 3 |
| Capsule Dispersion A | 3.06 g | — | — | — |
| Capsule Dispersion B | — | 3.06 g | — | — |
| Capsule Dispersion C | — | — | 3.06 g | — |
| Capsule Dispersion D | — | — | — | 3.06 g |
| Coupling Component Dispersion | 1.0 g | 1.0 g | 1.0 g | 1.0 g |
| Basic Substance Dispersion | 0.66 g | 0.66 g | 0.66 g | 0.66 g |
| Color Formation Accelerating Agent | 2.88 g | 2.88 g | 2.88 g | 2.88 g |
| Pigment Dispersion A | 1.76 g | 1.76 g | 1.76 g | 1.76 g |
| Pigment Dispersion B | 0.31 g | 0.31 g | 0.31 g | 0.31 g |
| Pigment Dispersion C | 0.43 g | 0.43 g | 0.43 g | 0.43 g |

The four recording materials thus prepared were subjected to the following tests: static color formation test, dynamic color formation test, and color density.

The results are shown in Table 2. (Testing Methods)

Static Color Formation Test

The recording material was pressed onto a hot plate maintained at 120° C. under a load of 500 G/cm$^2$ for about 5 seconds.

Dynamic Color Formation Test

A thermal head printing apparatus (produced by Matsushita Densi Buhin Co., Ltd.) was provided with a 330-ohm line head and an electric current of 1.6 msec was passed at 16.4 V to achieve printing.

Color Density

The coating was exposed to light by use of a Ricopy Super Dry 100 (produced by Ricoh Co., Ltd.). Then the cyan density (OD) in the background and color-formed areas was measured with a Macbeth densitometer.

TABLE 2

| Heat Recording Material | Image Density | Blue Density in Background |
|---|---|---|
| Comp. Example 1 | 1.32 | 0.20 |
| Example 1 | 1.30 | 0.13 |
| Example 2 | 1.29 | 0.09 |
| Example 3 | 1.29 | 0.083 |

As can be seen from the above results, if the filtration treatment is applied, the background fog density is decreased as compared with the case that the microcapsule dispersion is used as is (i.e., without filtration).

If the ion exchange treatment is applied a further reduction in the background fog density is provided.

While the invention has been described in detail and with reference to specific embodiments thereof, it will be apparent to one skilled in the art that various changes and modifications can be made therein without departing from the spirit and scope thereof.

What is claimed is:

1. A recording material comprising a support and a recording layer on the support, said recording layer containing a coupling agent and containing microcapsules containing a light sensitive and heat sensitive diazo compound, said coupling agent being capable of coupling with the diazo compound to form a recorded image, and said coupling agent and said microcapsules being present in said recording material in an amount which is effective to impart a heat color forming property to said recording material, wherein a microcapsule dispersion which is coated on the support to form the recording layer is prepared by preparing an emulsion containing at least a light sensitive and heat sensitive diazo compound and a microcapsule wall-forming substance, forming microcapsule walls on emulsion droplets, and removing diazo compound remaining unincluded in the microcapsules formed from the emulsion by an ion exchange treatment.

2. The recording material as in claim 1, wherein said microcapsule walls on emulsion droplets are walls of a polymeric substance selected from the group consisting of polyurethane, polyurea, polyamide, polyester, polycarbonate, a urea-formaldehyde resin, a melamine resin, polystyrene, a styrene-methacrylate copolymer, a styrene-acrylate copolymer, gelatin, polyvinyl pyrrolidone, polyvinyl alcohol, or mixtures comprising two or more of said polymeric substances.

3. The recording material as in claim 2, wherein said diazo compound is coated in an amount of from 0.05 to 5.0 g/m$^2$ and said coupling component is used in an amount of from 0.1 to 10 parts by weight per part by weight of the diazo compound.

4. The recording material of claim 1, wherein said ion exchange treatment is an ion exchange treatment in an aqueous dispersion.

5. A recording material as in claim 1, wherein said diazo compound is coated in an amount of from 0.05 to 5.0 g/m$^2$.

6. A recording material as in claim 2, wherein the coupling component is used in an amount of from 0.1 to 10 parts by weight per part by weight of the diazo compound.

7. A recording material as in claim 1, wherein the recording layer additionally contains a basic substance.

8. A recording material as in claim 7, wherein said diazo compound is coated in an amount of from 0.05 to 5.0 g/m$^2$.

9. A recording material as in claim 7, wherein the amounts of the coupling component and the basic substance are from 0.1 to 10 parts by weight, and an amount of up to 20 parts by weight, respectively, per part by weight of the diazo compound.

10. A recording material as in claim 8, wherein the amounts of the coupling component and the basic substance are from 0.1 to 10 parts by weight, and an amount of up to 20 parts by weight, respectively, per part by weight of the diazo compound.

11. A recording material as in claim 1, wherein the coupling component is used in an amount of from 0.1 to 10 parts by weight per part by weight of the diazo compound.

12. A recording material as in claim 1, wherein the treatment for removing the diazo compound is carried out after formation of the microcapsules but before mixing with other additives.

* * * * *